US008136282B2

(12) United States Patent
Valeij et al.

(10) Patent No.: US 8,136,282 B2
(45) Date of Patent: Mar. 20, 2012

(54) DISPLAY MEANS

(75) Inventors: Thomas Valeij, Huddinge (SE); Jari Kekkonen, Tullinge (SE); Björn Sao, Fairfield, CT (US)

(73) Assignee: Expand International AB, Johanneshov (SE)

( * ) Notice: Subject to any disclaimer, the term of this patent is extended or adjusted under 35 U.S.C. 154(b) by 476 days.

(21) Appl. No.: 12/087,115

(22) PCT Filed: May 2, 2007

(86) PCT No.: PCT/SE2007/050299

§ 371 (c)(1),
(2), (4) Date: Jun. 26, 2008

(87) PCT Pub. No.: WO2007/126387

PCT Pub. Date: Nov. 8, 2007

(65) Prior Publication Data

US 2009/0007474 A1 Jan. 8, 2009

(30) Foreign Application Priority Data

May 2, 2006 (SE) ..... 0600991

(51) Int. Cl.
*G09F 15/00* (2006.01)

(52) U.S. Cl. ..... 40/610; 40/600; 40/604

(58) Field of Classification Search ..... 248/900, 248/548, 160, 158, 188.7; 40/610, 515, 611.11, 40/608

See application file for complete search history.

(56) References Cited

U.S. PATENT DOCUMENTS

| | | | | | |
|---|---|---|---|---|---|
| 2,364,695 | A | * | 12/1944 | Coleman | 160/25 |
| 2,530,877 | A | * | 11/1950 | Heck et al. | 160/24 |
| 4,033,536 | A | | 7/1977 | Hillstrom | |
| 4,038,769 | A | * | 8/1977 | Werner | 40/610 |
| 4,498,657 | A | * | 2/1985 | Werner | 248/623 |
| 4,863,138 | A | * | 9/1989 | Dicke et al. | 248/576 |
| 5,172,745 | A | * | 12/1992 | Wang | 160/370.22 |
| 5,653,278 | A | * | 8/1997 | Cheng | 160/370.22 |

(Continued)

FOREIGN PATENT DOCUMENTS

EP 0 412 281 6/1990

(Continued)

OTHER PUBLICATIONS

International Search Report for PCT/SE2007/050299, mailed May 18, 2007.

*Primary Examiner* — Casandra Davis

(74) *Attorney, Agent, or Firm* — Drinker Biddle & Reath LLP

(57) ABSTRACT

A display adapted for use indoors and outdoors includes a stand adapted to secure a first screen. The stand comprises a first part which supports against an underlying supportive surface and comprises a first bobbin in the first part. The first screen can be wound onto and withdrawn from the first bobbin. The stand also comprises at least one support which in a support mode supports against the surface. The support is arranged to provide a turning moment which is anti-twisting in relation to the turning moment created by a wind pressure acting on the first screen, wherein $M_t \geqq M_p$. The stand also comprises at least one foldable pole, or telescopic pole. The stand also includes a number of springs arranged in connection to the at least one pole, and operable to make the display bendable in windy conditions, and to withstand twisting of the springs in windy conditions.

13 Claims, 10 Drawing Sheets

U.S. PATENT DOCUMENTS

| | | | | |
|---|---|---|---|---|
| 5,829,178 | A * | 11/1998 | Hillstrom | 40/610 |
| 5,878,519 | A * | 3/1999 | Huyck et al. | 40/612 |
| 6,115,951 | A * | 9/2000 | Jing et al. | 40/610 |
| 6,237,268 | B1 | 5/2001 | Levin | |
| 6,604,719 | B1 | 8/2003 | Dicke et al. | |
| 6,643,966 | B2 * | 11/2003 | Schmitt | 40/610 |
| 6,755,381 | B1 * | 6/2004 | Levin et al. | 248/163.1 |
| 6,836,988 | B2 * | 1/2005 | Zarelius | 40/610 |
| 6,991,019 | B2 * | 1/2006 | Chang | 160/24 |
| 7,261,051 | B2 * | 8/2007 | Tipaldo | 116/63 P |
| 2002/0050083 | A1 * | 5/2002 | Zarelius | 40/514 |
| 2004/0159753 | A1 | 8/2004 | LaMotte | |
| 2005/0097798 | A1 | 5/2005 | Evans et al. | |

FOREIGN PATENT DOCUMENTS

| | | |
|---|---|---|
| WO | 92/01838 | 2/1992 |

* cited by examiner $12_1$
$12_2$
$20_1$
1
131
$132_1$
10
$11_1'$
$11_1$
$132_2$
130'
130
$11_1''$
130'

DISPLAY MEANS

This application is the U.S. national phase of International Application No. PCT/SE2007/050299, filed 2May 2007, which designated the U.S. and claims priority to Swedish Patent Application No. 0600991-4, filed 2May 2006, the entire contents of each of which are hereby incorporated by reference.

TECHNICAL FIELD OF THE INVENTION

The present invention relates generally to a display means and, for instance, more particularly to a display means that includes a readily collapsed and readily erected stand, where the stand used can be adapted to secure a flexible information-presenting screen when in its erected state, and by flexible being meant that the screen can be rolled up onto and unrolled from a bobbin or a rod, normally in the form of a hollow-cylindrical body.

BACKGROUND OF THE INVENTION

A roll-up/retractable bannerstand generally uses some kind of pole or pin holding the printed graphics. To use this type of product outdoors, when windy conditions, creates rather large force on the graphics and the pole. This force increases to dramatic levels even when the wind speed is relatively moderate. The result is that either something breaks or the complete product trips over to the ground. Therefore it is not possible to use this type of product outdoors whenever there is a risk for windy conditions.

The patent document U.S. Pat. No. 6,237,268 discloses a sign stand 10 (see FIG. 1) comprising a base 12, a resilient member 14, an upright member 16 and a sign 18. The resilient member 14 is shown in FIG. 4 to include a spring assembly 50, a pair of mounting brackets 52 and 54 and fasteners 56. Spring assembly 50 includes a coil spring 58 and a pair of spring plugs 60 and 62 are shown to include at least one helical thread-like protrusion 72, which permits the plugs 60 and 62 to hi threadably engage the interior section 80 of the coil spring 58.

The patent document U.S. Pat. No. 6,604,719 discloses a sign stand assembly 10 (see e.g. FIGS. 1 and 2) comprising a message panel assembly 12, a mast 24, a mast coupler assembly 30, a clamp member 34, a resilient support assembly 50 and legs 64. Referring to FIGS. 13 and 14, the resilient support assembly 50 includes a coil spring 64, which is of a conventional helical wound wire design having cut ends 66. The resilient support assembly 50 includes one or more spring mount adapters generally indicated at 70.

The patent document U.S. Pat. No. 4,033,536 discloses a poster display device 10 (see FIG. 1) comprising a poster frame 14 which is mounted to a base structure 12 by a pair of extension coil springs 18 and 19, placed with a distance to each other corresponding substantially to the size of the poster frame 14. Referring to FIG. 4, the preferred manner of mounting the coil springs 18 and 19 to the base 12 and poster frame 14 of the display structure 10 is shown. The mounting bracket 20 comprises a metal plate 22 having three stepped levels 28, 30 and 32. As illustrated in FIG. 2, mounting bracket 20 is adapted to be disposed between a pair of adjacent coils 18*a* and 18*b* at one end of coil spring 18. A similar mounting bracket 24 is disposed between an adjacent pair of coils 18*c* and 18*d* at the opposite end of coil spring 18. In this manner, mounting brackets 20 and 24 are rigidly secured in coil spring 18 while deadening only a minimum number of coils. Thus, the majority of the coils in coil spring 18 remains active.

The patent document U.S. Pat. No. 6,115,951 discloses a portable retroreflective sign system 10 (see e.g. FIGS. 1 and 2) including a retroreflective sign, which when in its rolled position, is housed in a box 14 with a hinged cover 16. Shown in FIG. 2, the box 14 is in an opened position. In addition, the box 14 has legs 22 which can swivel about points 24 outwardly to provide greater stability and support of the opened sign, together with the box 14, to prevent it from tipping over in windy conditions.

Although, the above listed documents in different ways addresses the problem of using different types of sign stands outdoors, when windy conditions, no one of the solutions given in these documents do present a solution suitable for implementing in a portable and compact roll-up/retractable bannerstand, i.e. the solution should be compact and light and in the same time having the function that it will work when windy conditions.

SUMMARY OF THE INVENTION

It is an object of the present invention to solve the above mentioned problems. This is achieved with a display means according to claim 1. The display means is adapted for use both indoors and outdoors and comprises a stand 30: adapted to secure a first screen. The stand comprises a first part which support against an underlying supportive surface and comprises a first bobbin enclosed in a cavity in the first part. The first screen can be wounded onto and withdrawn from the first bobbin. The stand also comprises at least one support means which in a support mode supports against the surface. The support means Is/are arranged to provide a turning moment ($M_t$) which is ant-twisting in relation to the turning moment ($M_p$) created by a wind pressure (P) acting on said first screen ($\mathbf{20}_1$), wherein $M_t \geqq M_p$. The stand also comprises at least one foldable pole means or a telescopic pole means. The stand also comprises a means arranged in connection to said at least one pole means, and operable to make said display means bendable in windy conditions, and to withstand twisting of the means in windy conditions. The means comprises n number of coil springs, wherein n is an integer and $n \geqq 2$.

This solution is adapted for implementing in a portable and compact roll-up/retractable bannerstand. With this solution the pole and the screen/graphics will bend when the conditions are windy. When the wind increases to a certain speed the screen/graphics starts to bend. Increasing wind speed causes the screen/graphics to bend more, and at a given wind speed it will oscillate in a state of equilibrium, substantially parallel to the ground. When the wind speed decreases, the means will start to raise the pole and the screen/graphics to a more upright position, and if no wind it raises to a full vertical position. The use of at least two springs enables the size vs. spring force to be optimized which leads to a product that is portable and slimmed in size. The use of at least two springs also give a controlled motion in two directions, i.e. forwards and backwards relatively to the screen/graphics. This gives the advantage of no twisting of the screen/graphics, with the result that the message of the screen/graphics is visible too a high extent and reduced risk of damage on the screen/graphics material.

A further advantage in this context is achieved if the springs are coil springs and/or leaf springs. A further advantage in this context is achieved if said means is arranged in the vicinity of said first part, and comprises two stiffening means arranged in parallel with one of said at least one pole means and opposite to each other in relation to said one of said at least one pole means, and in that said means also comprises three coil springs, wherein one coil spring at one end is secured at a first part of said pole means, said first part being arranged in the vicinity of said first part, and at the other end is secured at a second part of said pole means, wherein said first and second part are arranged with a distance from each other and partly being encircled by said coil spring, wherein the other two coil springs are arranged opposite to each other in relation to said pole means, and at one end is secured to one of said stiffening means, and at the other end is secured to a pin arranged perpendicular in relation to said pole means.

Furthermore, it is an advantage in this context if said stiffening means each is U-shaped with the open ends arranged in the vicinity of said first part.

According to another embodiment, it is an advantage if said stand comprises at least two pole means, wherein one pole means is arranged in the vicinity of one end of said first part, and the other pole means is arranged in the vicinity of the other end of said first part, and in that said means comprises a resilient member for each pole means which resilient member is arranged in the vicinity of said first part and defining a longitudinal axis which is parallel with said pole means, wherein each resilient member comprises n number of springs, wherein n is an integer and $n \geqq 1$.

A further advantage in this context is achieved if n is an even number, and in that said stand also comprises a first mounting means and a second mounting means, each of which is fixed to each of said pole means in a perpendicular relation to the lengthwise direction of each of said pole means, wherein said n coil springs are fixed to said first and second mounting means in such a way that n/2 number of said coil springs is/are arranged on a first side in relation to each of said pole means, and n/2 number of said coil springs is/are arranged on a second side in relation to each of said pole means, wherein said second side is opposite to said first side in relation to each of said pole means.

According to another embodiment, it is an advantage if n is an odd number, and in that said stand also comprises a first mounting means and a second mounting means, each of which is fixed to each of said pole means in a perpendicular relation to the lengthwise direction of each of said pole means, wherein said n coil springs are fixed to said first and second mounting means in such a way that one coil spring is in line with each of said pole means and $$\left[\frac{n}{2}\right]$$

number of said coil springs is/are arranged on a first side in relation to each of said pole means ($\mathbf{12}_1, \ldots, \mathbf{12}_m$), and $$\left[\frac{n}{2}\right]$$

number of said coil springs is/are arranged on a second side in relation to each of said pole means, wherein said second side is opposite to said first side in relation each of said pole means.

Furthermore, it is an advantage in this context if said n coil springs are fixed to said first and second mounting means with the aid of threaded fastening means.

A further advantage in this context is achieved if each of said first and second mounting means is fixed to each of said pole means with the aid of a threaded fastening means.

Furthermore, it is an advantage in this context if each of said first and second mounting means also comprises a tubular part perpendicular to a part of said first and second mounting means to which said n coil springs are fixed, which tubular part has an inner diameter fitting to the outer diameter of each of said pole means.

A further advantage in this context if achieved if each of said tubular parts is fixed to each of said pole means with the aid of threaded fastening means.

Furthermore, it is an advantage in this context if said stand also is adapted to secure a second screen, wherein said stand also comprises a second part which support against said underlying supportive surface (u) and comprises a second bobbin enclosed in a cavity in said second part, wherein said second screen can be wounded onto and withdrawn from said second bobbin.

A further advantage in this context is achieved if each of said first part and said second part correspond to each other, but are fixed in relation to each other in a reversed relationship.

It will be noted that the term "comprises/comprising" as used in this description is intended to denote the presence of a given characteristic, step or component, without excluding the presence of one or more other characteristics features, integers, steps, components or groups thereof.

Embodiments of the invention will now be described with reference to the accompanying drawings, in which:

DETAILED DESCRIPTION

Figure 1:
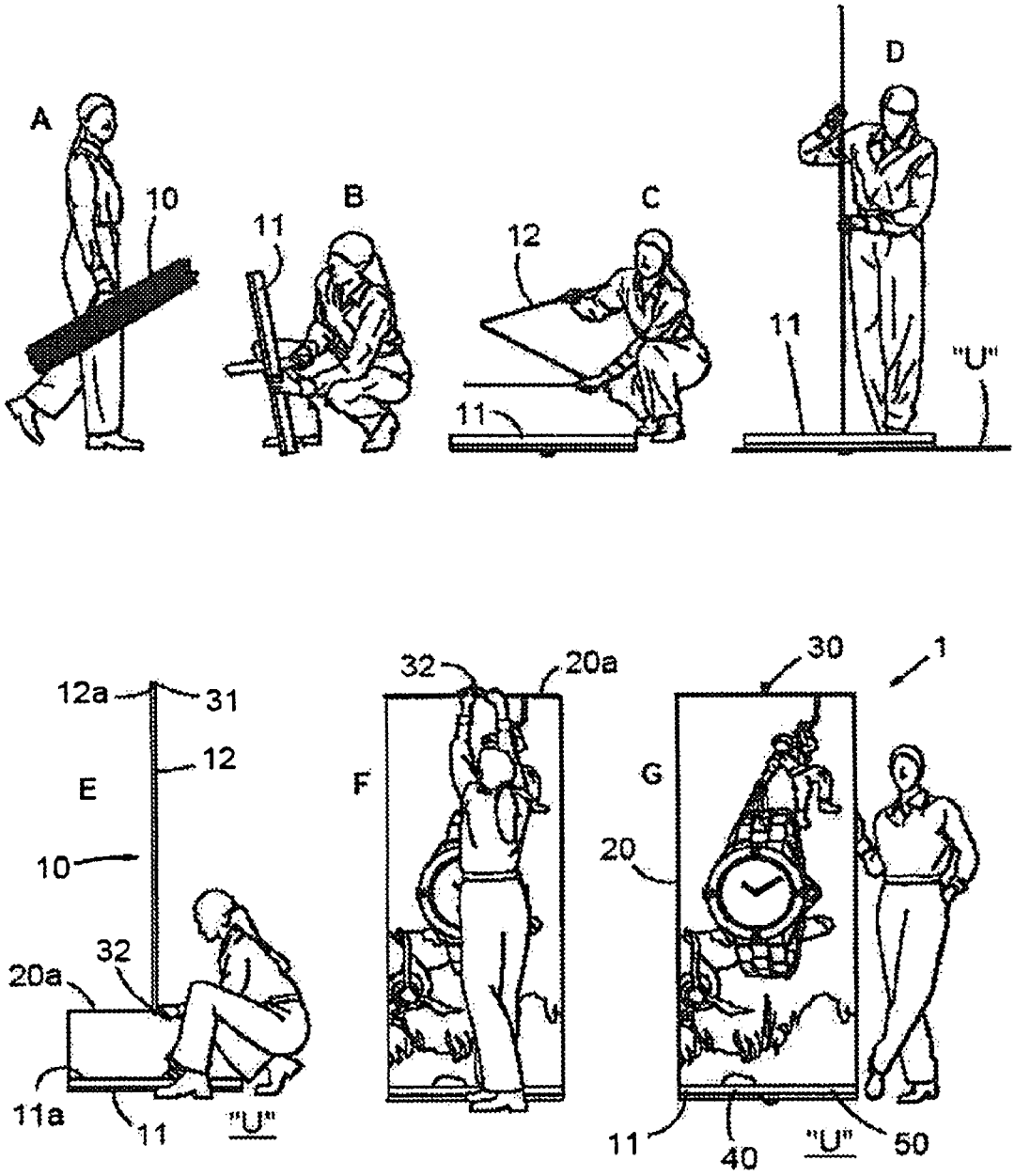
FIG. 1 illustrates assembly sequences A-G, applicable to an earlier known display means.

In FIG. 1 there is disclosed a more or less complete assembly sequence with the aid of individual assembly steps referenced A-G of a display means 1, this assembly sequence or erection sequence also being applicable to the display means 1 according to the present invention.

According to step A, the display means 1 comprises a stand 10, which in a fully erected state (steps F, G) firmly supports a screen 20, wherein the stand 10 comprises a first part 11 which supports against an underlying supportive surface U (step D), and further includes a foldable part 12 which, when the stand 10 is erected, extends upwardly from the first part 11.

One upwardly extending end part 12*a* of the second part 12 (step E) has a first coupling element 31 included in a two-part coupling arrangement 30, where-with the other coupling element 32 of the coupling arrangement is joined to the screen 20 either directly or indirectly, and orientated in connection with the upper edge part 20*a* of the screen 20.

The screen 20 can be wound onto and unwound from a bobbin 40 enclosed in a cavity (not shown) located in the first part 11, wherein the bobbin 40 can be actuated by a spring arrangement 50 that includes an associated spring unit.

The spring arrangement 50 is designed to act on the screen 20 with a decreasing force during a screen wind-up phase (the steps from F to E) with the aid of a spring unit consisting of helically twisted or wound metal wire, wherewith the screen 20 is acted upon at an increasing force during an unwinding phase (the steps from E to F).

The spring arrangement 50 is also adapted to act on the screen 20 with a chosen initial power when the screen 20 has been fully wound around the bobbin 40 (in accordance with the step D).

The first part 11 includes a slot 11*a* through which the screen 20 passes so as to be unwound from or wound onto the bobbin 40 present in the cavity.

Figure 2:
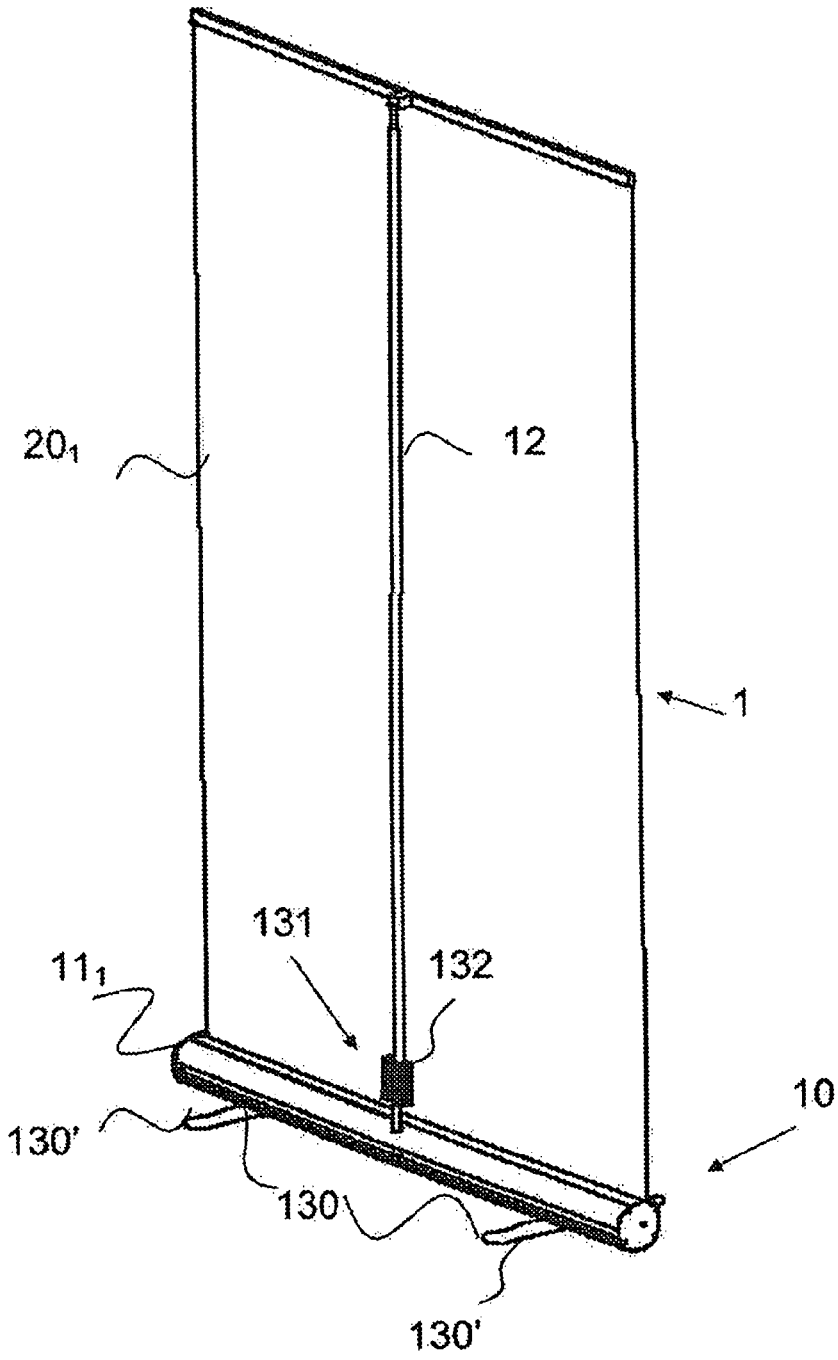
FIG. 2 is a perspective view of a first embodiment of the display means according to the present invention.

In FIG. 2 there is disclosed a perspective view of a first embodiment of the display means 1 according to the present invention. The display means 1 is adapted for use both indoors and outdoors. The display means 1 comprises a stand 10 adapted to secure a first screen $\mathbf{20}_1$. The stand 10 also comprises a first part $\mathbf{11}_1$ which support against an underlying supportive surface, u, and comprises a first bobbin $\mathbf{40}_i$ enclosed in a cavity in said first part $\mathbf{11}_1$. The first screen $\mathbf{20}_1$ can be wound onto and withdrawn from the first bobbin $\mathbf{40}_i$ (not disclosed in FIG. 2). The stand 10 also comprises two support means 130, here disclosed as legs 130, which in a support mode, the one disclosed in FIG. 2, are arranged perpendicular in relation to the lengthwise direction of the first part $\mathbf{11}_1$ and supports against the surface, u. Each of the two support means 130 has a predominant part of its weight placed in the vicinity of the two end parts 130', 130" (only one end is disclosed in FIG. 2) of the two support means 130. It is pointed out that the support means 130 can have any shape, as long as it/they is/are arranged to provide a turning moment $M_t$ which is anti-twisting in relation to the turning moment $M_p$ created by a wind pressure P acting on the first screen $\mathbf{20}_1$, wherein $M_t \geqq M_p$. (See FIG. 9.) The stand 10 also comprises a foldable pole means 12 or a telescopic pole means 12. In the general case the stand 10 comprises at least one pole means $\mathbf{12}_1, \ldots, \mathbf{12}_m$, wherein m is an integer and $m \geqq 1$. The stand 10 also comprises a means 131 arranged in connection to the pole means 12, and operable to make the display means 1 bendable in windy conditions, and to withstand twisting of the means 130 in windy conditions. The pole means 12 also comprises a resilient member 132 arranged in the vicinity of the first part $\mathbf{11}_1$ and defining a longitudinal axis which is parallel with the pole means 12. In FIG. 2, the resilient member 132 comprises two coil springs $\mathbf{132}_1$, $\mathbf{132}_2$ (see FIG. 4) arranged in parallel and in the vicinity of each other.

Figure 3:
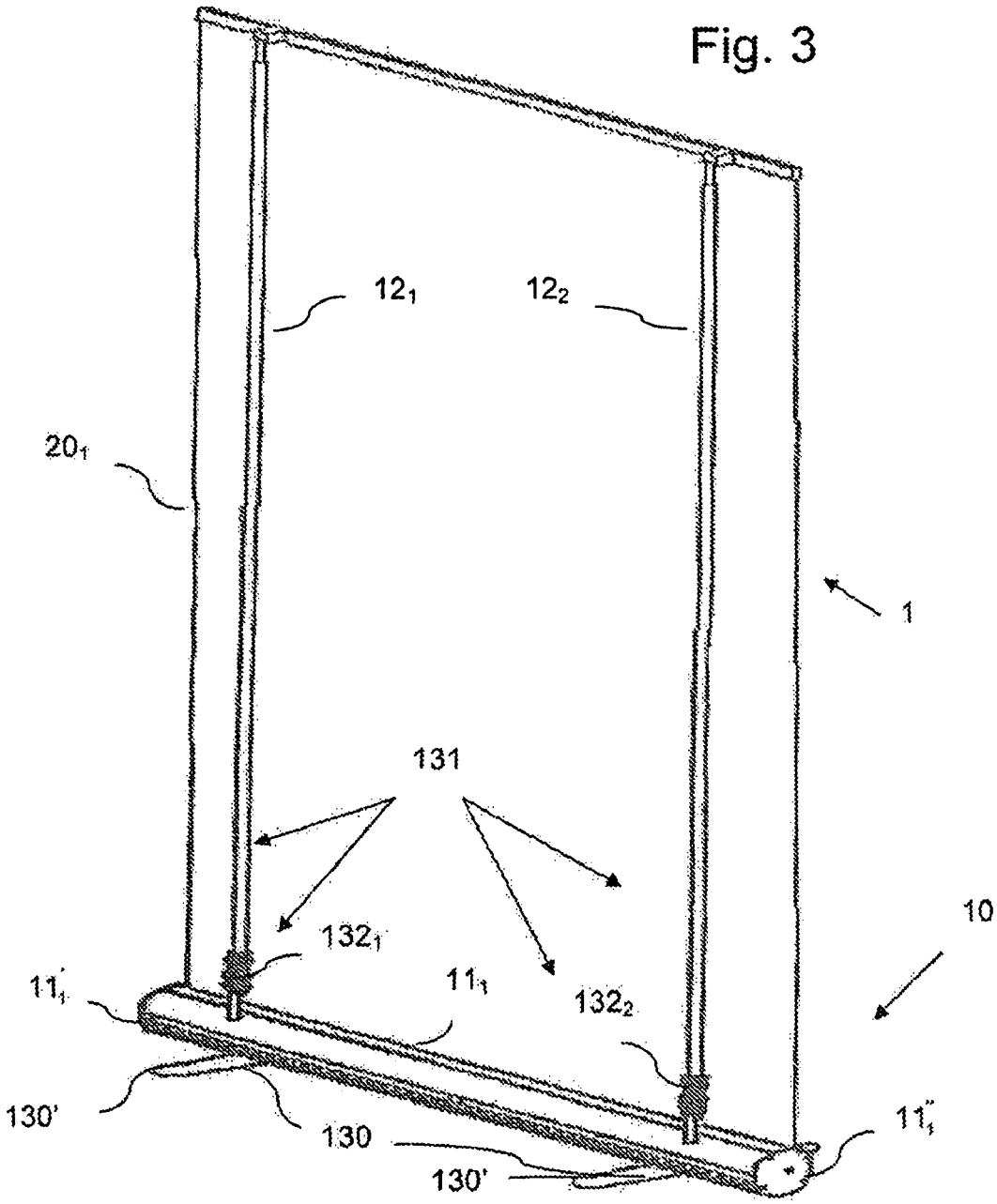
FIG. 3 is a perspective view of a second embodiment of the display means according to the present invention.

In FIG. 3 there is disclosed a perspective view of a second embodiment of the display means 1 according to the present invention. The display means 1 is adapted for use both indoors and outdoors. The main difference between the display means 1 disclosed in FIG. 2 and FIG. 3 is that the display means 1 disclosed in FIG. 3 comprises two foldable or telescopic pole means $\mathbf{12}_1$ and $\mathbf{12}_2$. The two pole means $\mathbf{12}_1$ and $\mathbf{12}_2$ are arranged with a long distance between each other. The pole means $\mathbf{12}_1$ is arranged in the vicinity of a first end $\mathbf{11'}_1$ of said first part $\mathbf{11}_1$, and the other pole means $\mathbf{12}_2$ is arranged in the vicinity of the second is end $\mathbf{11''}_1$ of the first part $\mathbf{11}_1$. In FIG. 3 there is also disclosed the means 131, which is operable to make said display means 1 bendable in windy conditions, and to withstand twisting of the means 130 in windy conditions. In this case, the means 131 comprises a resilient member in the form of two coil springs $\mathbf{132}_1$ and $\mathbf{132}_2$ for each pole means $\mathbf{12}_1$, $\mathbf{12}_2$. The means 131 also comprises the two pole means $\mathbf{12}_1$, $\mathbf{12}_2$. Corresponding reference signs in FIGS. 2 and 3 represent the corresponding elements and will not be described again.

Figure 5:
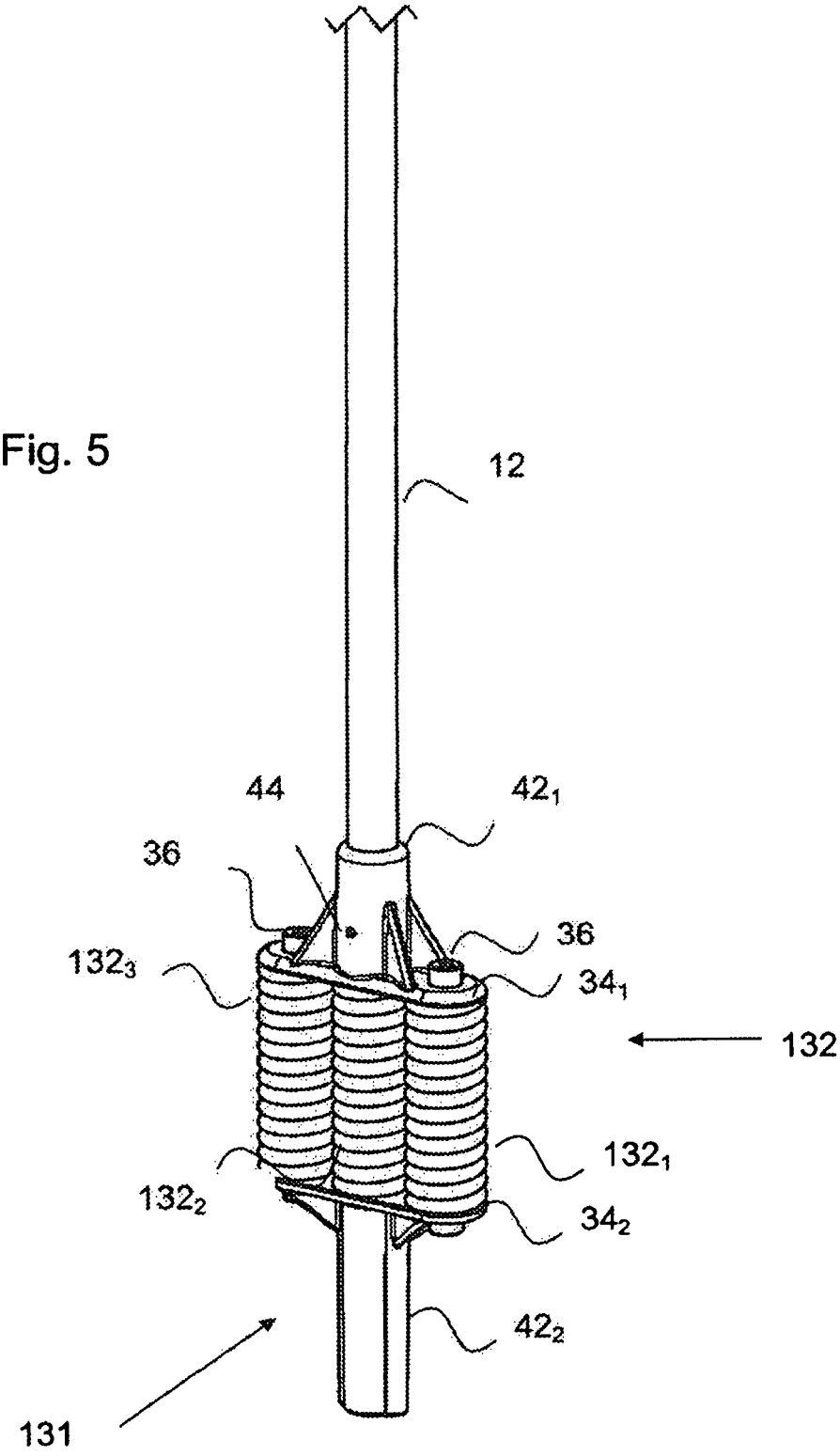
FIG. 5 is a perspective view of a second embodiment of the resilient member comprised in the display means according to the present invention.

In FIG. 5 there is disclosed the case, wherein the means 131 comprises a resilient member 132 which in turn comprises three coil springs, $\mathbf{132}_1$, $\mathbf{132}_2$, $\mathbf{132}_3$ arranged in parallel and in the vicinity of each other. The coil spring $\mathbf{132}_2$ in the middle is in line with the pole means 12.

Figure 4:
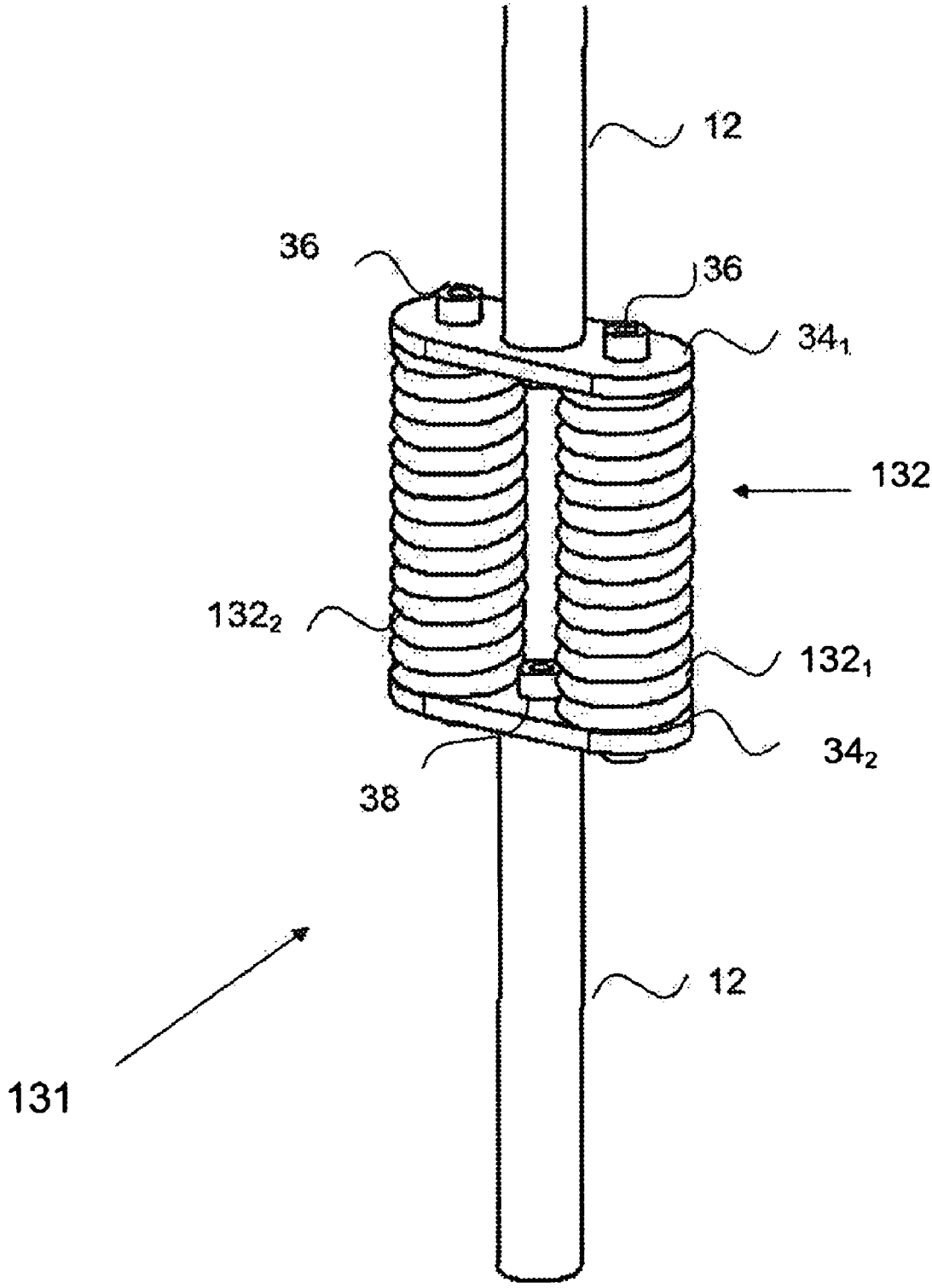
FIG. 4 is a perspective view of a first embodiment of the resilient member comprised in the display means according to the present invention.

As is apparent both in FIGS. 4 and 5, the stand 10 also comprises a first mounting means $\mathbf{34}_1$ and a second mounting means $\mathbf{34}_2$, each of which is fixed to the pole means 12 in a perpendicular relation to the lengthwise direction of the pole means 12. The coil springs $\mathbf{132}_1$, $\mathbf{132}_2$ (FIG. 3) or $\mathbf{132}_1$, $\mathbf{132}_2$, $\mathbf{132}_3$ (FIG. 4) are fixed to the first and second mounting means $\mathbf{34}_1$, $\mathbf{34}_2$ with the aid of threaded fastening means 36, e.g. a bolt.

As is apparent in FIG. 4, each of the first and second mounting means $\mathbf{34}_1$, $\mathbf{34}_2$ is fixed to the pole means 12 with the aid of a threaded fastening means 138, e.g. a bolt.

In FIG. 5 there is disclosed another embodiment, wherein each of the first and second mounting means $\mathbf{34}_1$, $\mathbf{34}_2$ also comprises a tubular part $\mathbf{42}_1$, $\mathbf{42}_2$ perpendicular to a part of the first and second mounting means $\mathbf{34}_1$, $\mathbf{34}_2$ to which the three coil springs $\mathbf{132}_1$, $\mathbf{132}_2$, $\mathbf{132}_3$ are fixed. The tubular part $\mathbf{42}_1$, $\mathbf{42}_2$ has an inner diameter fitting to the outer diameter of the pole means 12. Each of the tubular parts $\mathbf{42}_1$, $\mathbf{42}_2$ is fixed to the pole means 12 with the aid of threaded fastening means 44, e.g. a socket head cap screw.

Figure 6:
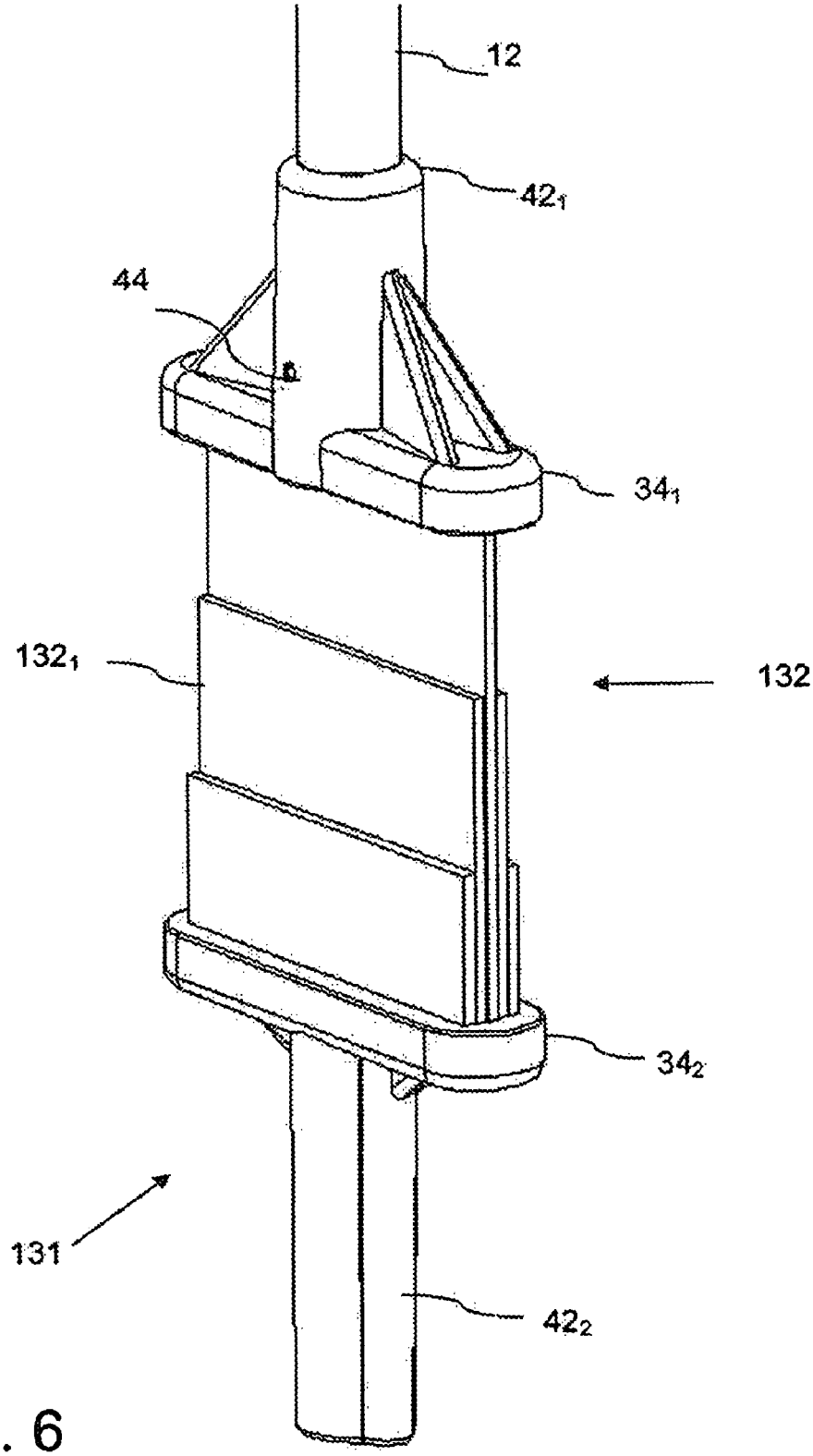
FIG. 6 is a perspective view of a third embodiment of the resilient member comprised in the display means according to the present invention.

In FIG. 6 there is disclosed a perspective view of a third embodiment of the resilient member 132 comprised in the display means 1 according to the present invention. In this embodiment the resilient member 132 comprises a leaf spring $\mathbf{132}_1$ which is fixed to the first and second mounting means $\mathbf{34}_1$, $\mathbf{34}_2$. The first and second mounting means $\mathbf{34}_1$, $\mathbf{34}_2$ comprise a tubular part $\mathbf{42}_1$, $\mathbf{42}_2$ which each has an inner diameter fitting to the outer diameter fo the pole means 12. Each of the tubular parts $\mathbf{42}_1$, $\mathbf{42}_2$ is fixed to the pole means 12 with the aid of a threaded fastening means 44, e.g. a socket head cap screw.

Figure 7:
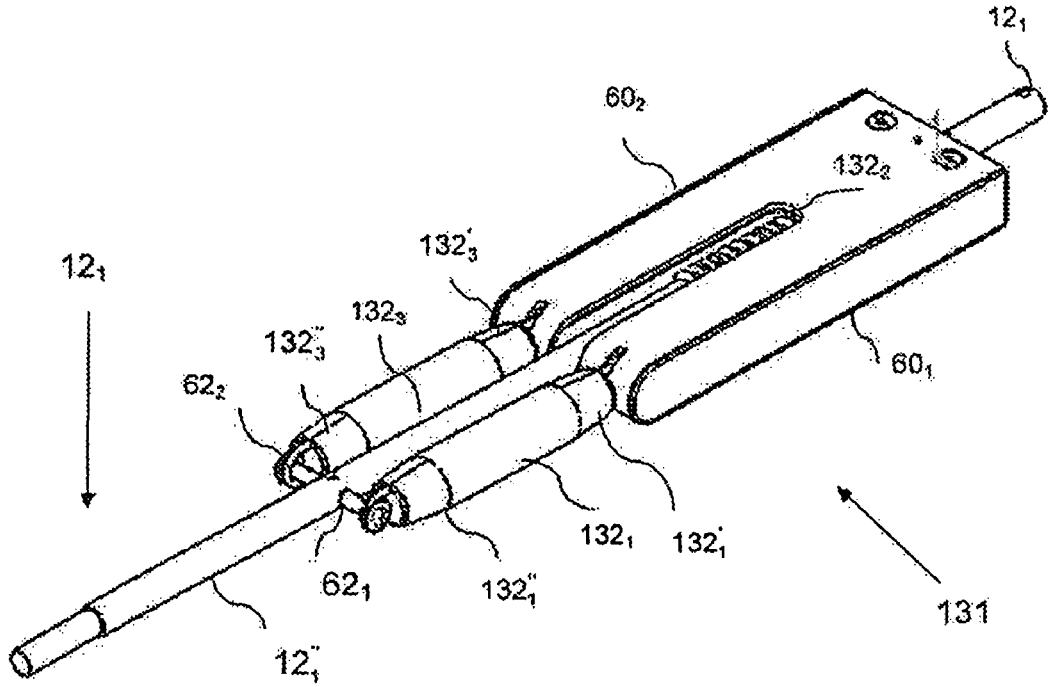
FIG. 7 is a perspective view of a part of a third embodiment of the display means according to the present invention.

In FIG. 7 there is disclosed a perspective view of a part of a third embodiment of the display means 1 according to the present invention. The main feature disclosed in FIG. 7 is the means 131 which is arranged in the vicinity of the first part $\mathbf{11}_1$ (not shown in FIG. 7, but see e.g. FIG. 2 or 3), and comprises two stiffening means $\mathbf{60}_1$, $\mathbf{60}_2$ arranged in parallel with the pole means $\mathbf{12}_1$, and opposite to each other in relation to the pole means $\mathbf{12}_1$. The means 131 also comprises three coil springs $\mathbf{132}_1$, $\mathbf{132}_2$, $\mathbf{132}_3$. The coil spring $\mathbf{132}_2$ in the middle is at one end $\mathbf{132'}_2$ secured at a first part $\mathbf{12'}_1$ of the pole means $\mathbf{12}_1$. The first part $\mathbf{12'}_1$ is being arranged in the vicinity of the first part $\mathbf{11}_1$. The coil spring $\mathbf{132}_2$ in the middle is at the other end $\mathbf{132''}_2$ secured at a second part $\mathbf{12''}_1$ of the pole means $\mathbf{12}_1$. The first $\mathbf{12'}_1$ and second part $\mathbf{12''}_1$ of the pole means $\mathbf{12}_1$ are arranged with a distance from each other and being partly encircled by the coil spring $\mathbf{132}_2$. The other two coil springs $132_1$, $132_3$ are arranged opposite to each other in relation to the pole means $12_1$. The two coils springs $132_1$, $132_3$ are at one end $132'_1$, $132'_3$ each secured to one of the stiffening means $60_1$, $60_2$, and at the other end $132''_1$, $132''_3$ secured to a pin $62_1$, $62_2$ arranged perpendicular to the pole means $12_1$ as is apparent in FIG. 7. The stiffening means $62_1$, $62_2$ is each U-shaped with the open ends arranged in the vicinity of the first part $11_1$, i.e., the first part $12'_1$ of the pole means $12_1$.

Figure 8:
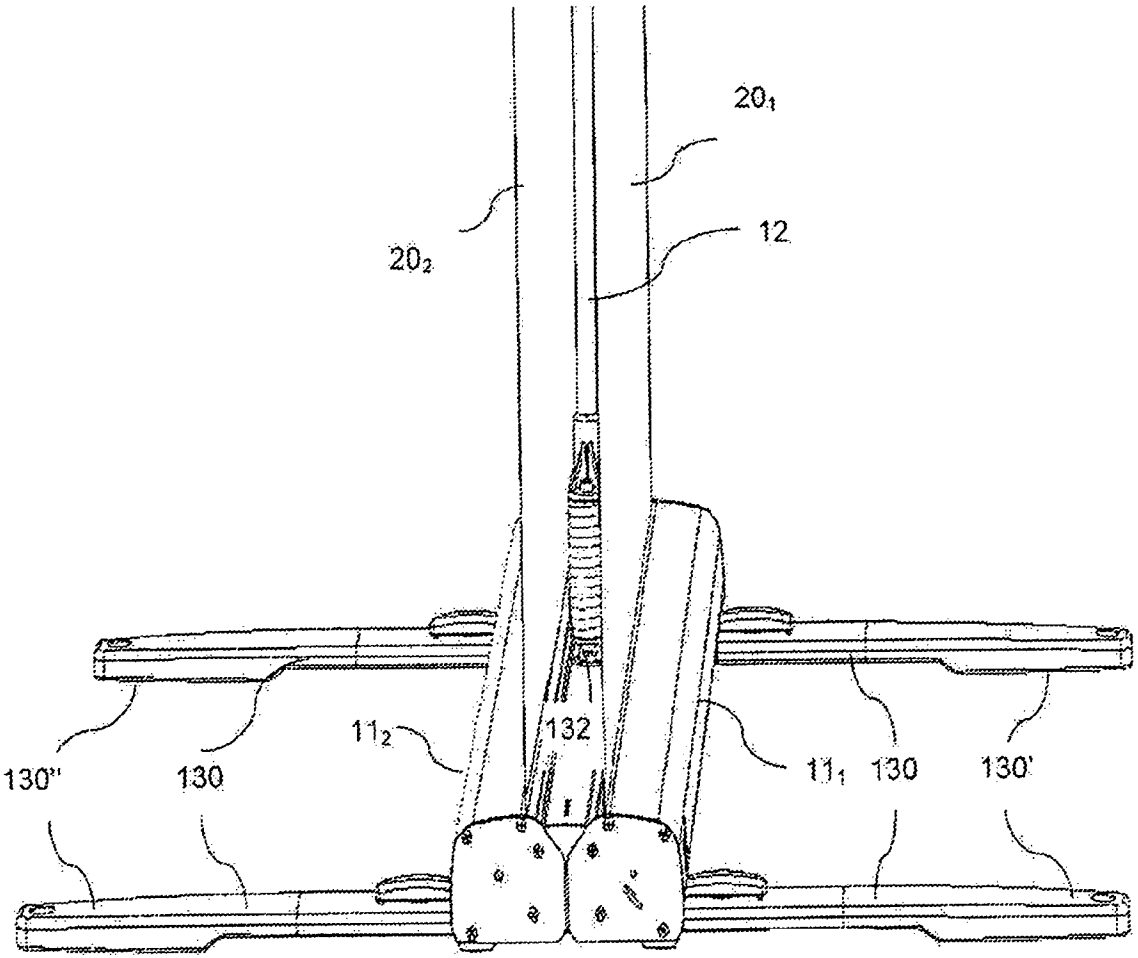
FIG. 8 is a perspective view of a second embodiment of the display means according to the present invention.

In FIG. 8 there is disclosed a second embodiment of the display means 1 according to the present invention. In this embodiment the stand 10 also comprises a second part $11_2$ which supports against the underlying supportive surface, u, and comprises a second bobbin $40_2$ (not disclosed in FIG. 8) enclosed in a cavity in the second part $11_2$. This stand 10 is adapted to secure a second screen $20_2$, wherein the second screen $20_2$ can be wound onto and withdrawn from the second bobbin $40_2$. As is apparent in FIG. 8, each of the first part $11_1$ and the second part $11_2$ correspond to each other, but are fixed in relation to each other in a reversed relationship.

Figure 9:
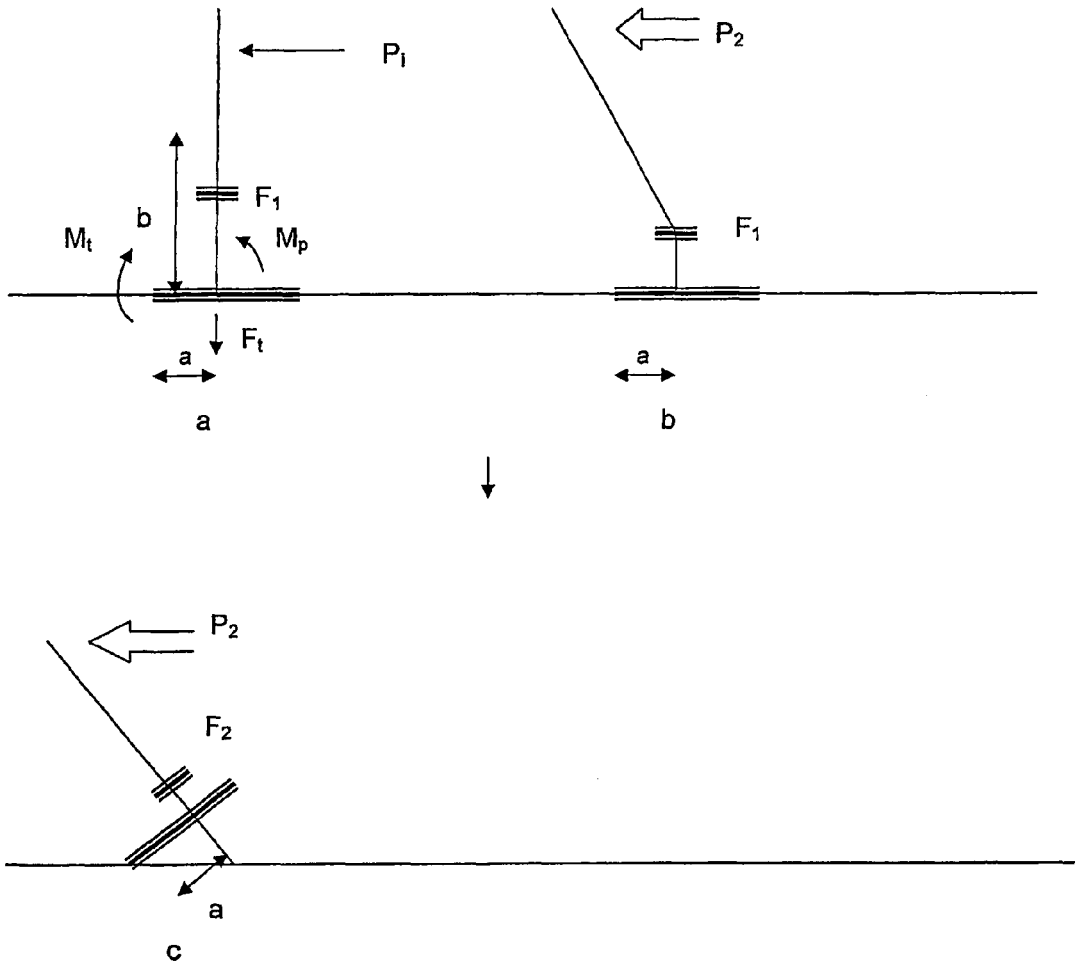
FIG. 9 *a-c* shows schematically the relationship between the wind force and the force of the resilient member of the display means according to the present invention.

In FIG. 9 *a-c*, there is schematically disclosed the relationship between the wind force and the force of the means 131/the resilient member 132 of the display means 1 according to the present invention. The display means 1 is only disclosed schematically in FIG. 9 *a-c*. In FIG. 9*a*, there is disclosed the case in which the wind pressure $P_1$ is not enough to overcome the force $F_1$ of the means 131/the resilient member 132, i.e. the screen/graphics will not start bending. In FIG. 9 *b* the wind pressure $P_2$ has increased enough to overcome the force $F_1$ of the means 131/the resilient member 132, i.e. the screen/graphics will start bending in a controlled manner. In FIG. 9 *c*, there is disclosed the case in which the force $F_2$ of the means 131/the resilient member 132 is too large, which means that even though the wind pressure $P_2$ is high, the screen/graphics will not start bending, leading to the tipping over to the ground. In FIG. 9*a* there is also disclosed the important fact that the support means 130 is/are arranged to provide a turning moment $M_t$ which is anti-twisting in relation to the turning moment $M_p$ created by a wind pressure $P_1$ acting on the first screen $20_1$, wherein $M_t \geqq M_p$. $M_t = F_t \cdot a$, wherein a is the active moment arm of the support means 130. $M_p = (P_1 \cdot \text{area}) \cdot b$, wherein area is the area of the first screen $20_1$ and b is the active moment arm of the first screen $20_1$.

Figure 10:
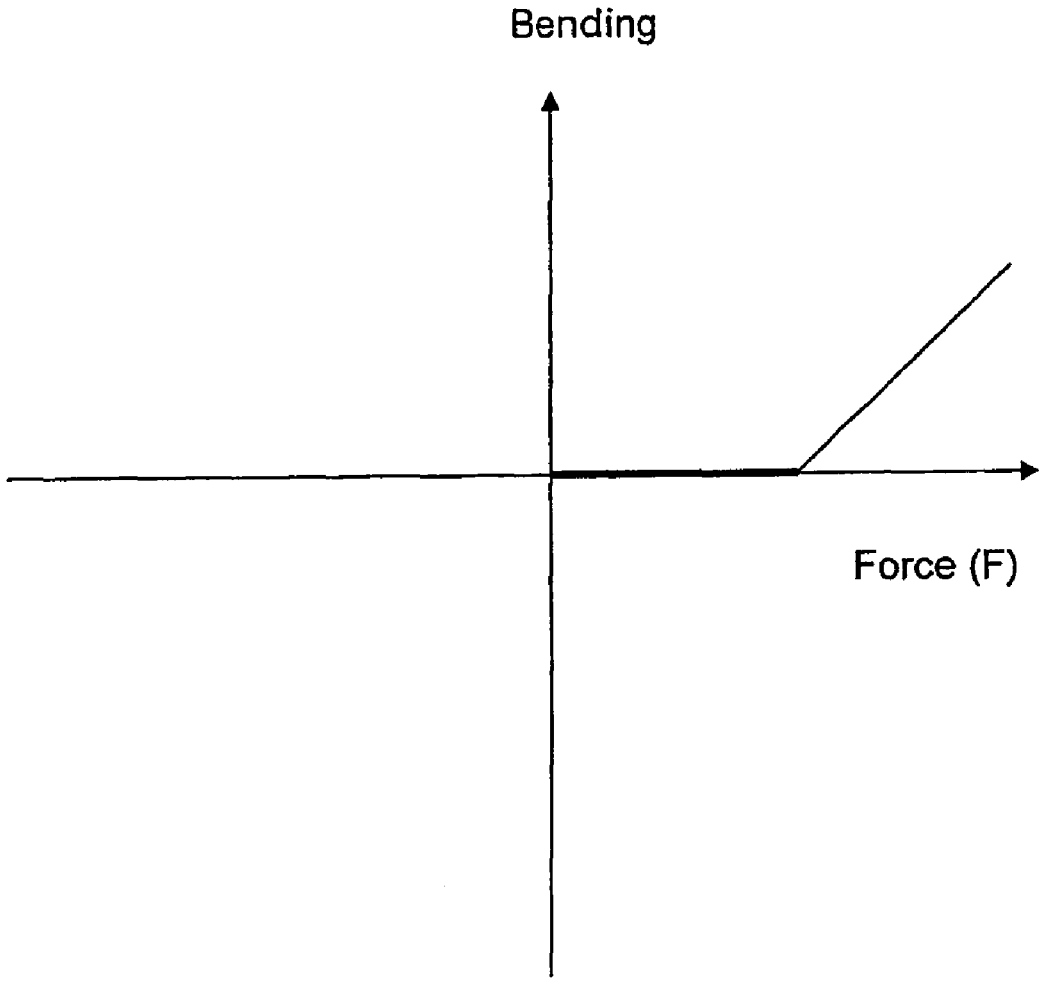
FIG. 10 is a graph illustrating the bending versus the wind force of a display means according to the present invention.

In FIG. 10 there is disclosed a graph illustrating the bending of the display means 1 versus the wind force F for a display means 1 according to the present invention. As is apparent in FIG. 10 the bending-begins when the wind force F overcomes the force of the means 131/the resilient member 132. If the wind force F increases, the screen/graphics start bending.

It is pointed out that the number of pole means can be varied in a great extent. The use of the different means 131/the resilient member 132 can also be varied/combined in a great extent.

It will be understood that the present invention is not restricted to be above mentioned embodiments, and that a person skilled in the art will be aware of the fact that many modifications are possible within the scope of the accompanying claims.

The invention claimed:

1. A display means adapted for use both indoors and outdoors comprising a stand adapted to secure a first screen, wherein said stand comprises a first part which supports against an underlying supportive surface and comprises a first bobbin enclosed in a cavity in said first part, wherein said first screen is wound onto and withdrawn from said first bobbin, wherein said stand also comprises at least one support means which in a support mode supports against said surface, and in that said support means is arranged to provide a turning moment ($M_t$) which is anti-twisting in relation to another turning moment created by a wind pressure ($M_p$) acting on said first screen, wherein $M_t \geqq M_p$, and in that said stand also comprises at least one foldable pole means, or telescopic pole means, and a means arranged in connection to said at least one pole means, and operable to make said display means bendable in windy conditions, and to withstand twisting of said means in windy conditions, wherein said means comprises n number of springs, wherein n is an integer and $n \geqq 2$.

2. The display means adapted for use both indoors and outdoors according to claim 1, wherein said springs are coil springs or leaf springs.

3. The display means adapted for use both indoors and outdoors according to claim 2, wherein said means is arranged in the vicinity of said first part, and comprises two stiffening means arranged in parallel with one of said at least one pole means and opposite to each other in relation to said one of said at least one pole means, and in that said means also comprises three coil springs, wherein one coil spring at one end is secured at a first part of said pole means, said first part of said at least one pole means being arranged in the vicinity of said first part, and at the other end is secured at a second part of said pole means, wherein said first and second parts of said at least one pole means are arranged with a distance from each other and partly being encircled by said coil spring, wherein the other two coil springs are arranged opposite to each other in relation to said pole means, and at one end is secured to one of said stiffening means and at the other end is secured to a pin arranged perpendicular in relation to said at least one pole means.

4. The display means adapted for use both indoors and outdoors according to claim 3, wherein said stiffening means each is U-shaped with the open ends arranged in the vicinity of said first part of said stand.

5. The display means adapted for use both indoors and outdoors according to claim 2, wherein said stand comprises at least two pole means, wherein one pole means is arranged in the vicinity of one end of said first part of said stand, and the other pole means is arranged in the vicinity of the other end of said first part of said stand, and in that said means comprises a resilient member for each pole means which resilient member is arranged in the vicinity of said first part of said stand and defining a longitudinal axis which is parallel with said pole means, wherein each resilient member comprises n number of springs, wherein n is an integer and $n \geqq 1$.

6. The display means adapted for use both indoors and outdoors according to claim 5, wherein n is an even number, and in that said stand also comprises a first mounting means and a second mounting means, each of which is fixed to each of said pole means in a perpendicular relation to the lengthwise direction of each of said pole means, wherein said n coil springs are fixed to said first and second mounting means in such a way that n/2 number of said coil springs is arranged on a first side in relation to each of said pole means, and n/2 number of said coil springs is arranged on a second side in relation to each of said pole means, wherein said second side is opposite to said first side in relation to each of said pole means.

7. The display means adapted for use both indoors and outdoors according to claim 6, wherein said n coil springs are fixed to said first and second mounting means with the aid of threaded fastening means.

8. The display means adapted for use both indoors and outdoors according to claim 6, wherein each of said first and second mounting means is fixed to each of said pole means with the aid of a threaded fastening means.

9. The display means adapted for use both indoors and outdoors according to claim 6, wherein each of said first and second mounting means also comprises a tubular part perpendicular to a part of said first and second mounting means to which said n coil springs are fixed, which said tubular part has an inner diameter fitting to the outer-diameter of each of said pole means.

10. The display means adapted for use both indoors and outdoors according to claim 9, wherein each of said tubular part is fixed to each of said pole means with the aid of a threaded fastening means.

11. The display means adapted for use both indoors and outdoors according to claim 5, wherein n is an odd number, and in that said stand also comprises a first mounting means and a second mounting means, each of which is fixed to each of said pole means in a perpendicular relation to the lengthwise direction of each of said pole means, wherein said n coil springs are fixed to said first and second mounting means in such a way that one coil spring is in line with each of said pole means and n/2 number of said coil springs is arranged on a first side in relation to each of said pole means, and number of said coil springs is arranged on a second side in relation to each of said pole means, wherein said second is opposite to said first side in relation to each of said pole means.

12. The display means adapted for use both indoors and outdoors according to claim 1, wherein said stand also is adapted to secure a second screen, wherein said stand also comprises a second part which supports against said underlying supportive surface and comprises a second bobbin enclosed in a cavity in said second part, wherein said second screen is wounded onto and withdrawn from said second bobbin.

13. The display means adapted for use both indoors and outdoors according to claim 12, wherein each of said first part and said second part correspond to each other, but are fixed in relation to each other in a reversed relationship.

* * * * *